US010478981B2

(12) United States Patent
Krauss et al.

(10) Patent No.: US 10,478,981 B2
(45) **Date of Patent: *Nov. 19, 2019**

(54) ELECTRIC SHAVER

(71) Applicant: Braun GmbH, Kronberg (DE)

(72) Inventors: Joachim Krauss, Seeheim-Jugenheim (DE); Johannes Stimpel, Wiesbaden (DE); Wolfgang Stegmann, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 15 days.

This patent is subject to a terminal disclaimer.

(21) Appl. No.: 15/717,109

(22) Filed: Sep. 27, 2017

(65) Prior Publication Data

US 2018/0085954 A1 Mar. 29, 2018

(30) Foreign Application Priority Data

Sep. 28, 2016 (EP) ..... 16191122
Sep. 25, 2017 (EP) ..... 17192949

(51) Int. Cl.
*B26B 19/38* (2006.01)
*B26B 19/04* (2006.01)
*B26B 19/28* (2006.01)

(52) U.S. Cl.
CPC ..... *B26B 19/3846* (2013.01); *B26B 19/04* (2013.01); *B26B 19/046* (2013.01); *B26B 19/048* (2013.01); *B26B 19/38* (2013.01); *B26B 19/382* (2013.01); *B26B 19/3853* (2013.01); *B26B 19/3866* (2013.01); *B26B 19/282* (2013.01)

(58) Field of Classification Search
CPC ..... B26B 19/04; B26B 19/046; B26B 19/048; B26B 19/282; B26B 19/38; B26B 19/382; B26B 19/3846; B26B 19/3853; B26B 19/3866
See application file for complete search history.

(56) References Cited

U.S. PATENT DOCUMENTS 3,396,462 A 8/1968 Dufresne
4,442,596 A * 4/1984 Nasu ..... B26B 19/3853 30/41
4,549,352 A * 10/1985 Ochiai ..... B26B 19/3853 30/41.5
4,631,825 A 12/1986 Kuriyama et al.
6,968,621 B1 * 11/2005 Steinberg ..... B26B 19/14 30/346.51
8,296,955 B2 * 10/2012 Sato ..... B26B 19/04 30/43.9

(Continued)

FOREIGN PATENT DOCUMENTS

EP 2769812 8/2014
GB 2101031 1/1983

(Continued)

OTHER PUBLICATIONS

European search report dated Apr. 5, 2017.

*Primary Examiner* — Hwei-Siu C Payer
(74) *Attorney, Agent, or Firm* — Ronald Terk Sia; Kevin C. Johnson

(57) ABSTRACT

An electric shaver having at least one drivable cutter element and at least one rinse opening having a horn shape for rinsing water through the interior of the shaver head.

16 Claims, 4 Drawing Sheets

(56) References Cited

U.S. PATENT DOCUMENTS

| | | | | |
|---|---|---|---|---|
| 8,627,574 | B2 * | 1/2014 | Shimizu | B26B 19/048 30/42 |
| 2003/0226259 | A1 * | 12/2003 | Oswald | B26B 19/04 30/43.92 |
| 2004/0221454 | A1 * | 11/2004 | Miyasaka | B26B 19/14 30/43.6 |
| 2006/0156550 | A1 * | 7/2006 | Beugels | B26B 19/00 30/45 |
| 2006/0179657 | A1 * | 8/2006 | Van Der Linden | B26B 19/38 30/41 |
| 2006/0265880 | A1 * | 11/2006 | Sagawa | B26B 19/048 30/43.92 |
| 2008/0034591 | A1 * | 2/2008 | Fung | B26B 19/02 30/43.92 |
| 2008/0209735 | A1 * | 9/2008 | Haczek | A45D 26/00 30/43.91 |
| 2018/0085941 | A1 * | 3/2018 | Krauss | B26B 19/048 |
| 2018/0085954 | A1 * | 3/2018 | Krauss | B26B 19/046 |
| 2018/0085955 | A1 * | 3/2018 | Krauss | B26B 19/046 |

FOREIGN PATENT DOCUMENTS

| | | |
|---|---|---|
| GB | 2129732 | 5/1984 |
| WO | WO 2005/000539 | 1/2005 |
| WO | WO 2005/000540 | 1/2005 |
| WO | WO 2018/060879 A1 * | 4/2018 |

* cited by examiner

ELECTRIC SHAVER

FIELD OF THE INVENTION

The present invention generally relates to cleaning and washing shavers with water or other fluids. More particularly, the present invention relates to electric shavers comprising a handle portion, a shaver head supported by said handle portion and including at least one drivable cutter element, and at least one rinse opening for rinsing water through the interior of said shaver head.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver or in the alternative in the shaver head thereof.

Irrespective of the architecture of the drive unit and the cutter element, the shaver head needs to be cleaned after shaving so as to remove hair dust or debris or hair stubbles from the cutter elements and other surfaces and elements in the interior of the shaver head. Shaver heads sometimes have internal hair chip chambers or hair dust chambers so as to collect the cut hairs in the interior of the shaver head and to avoid chipped hair deposits on other portions of the shaver. However, due to the small size of the hair particles, hair dust may reach other portions and may form deposits anywhere on the outer surface of the shaver head and the neck portion between the shaver head and the handle.

It therefore has already been suggested to wash the shaver head under the faucet of a sink where rinsing water is directed onto the shaver head. In order to also clean the interior of the shaver head and the undercutter under the perforated shear foil, the shaver head may include rinse openings so that the water may enter into the interior of the shaver head and rinse through the interior to clean the cutter elements, drive train elements and other interior surfaces of the shaver head.

For example, document EP 2 769 812 A1 discloses an electric shaver with a shaver head having a pair of rinse openings communicating with the interior thereof so that rinsing water may clean the interior of the shaver head. Said rinse openings are provided with slidable lids for opening and closing the rinse openings.

GB 2129732 A shows a shaver head having rinse openings at opposite sides thereof, wherein such rinse openings can be opened and closed by means of pivotable doors. Furthermore, WO 2005/000540 A1 discloses a shaver head with rotatory cutter elements, wherein sidewalls of the shaver head housing are provided with rectangular through holes forming rinse openings, wherein a closing member closing such rinse openings is attached to a shaving head holder so that the rinse openings are only opened when said shaver head holder is opened. A similar shaver head is shown in WO 2005/000539 A1, wherein an impeller for actively driving the washing fluid is rotatably received inside the shaver head and connected to the drive structure of the shaver head.

Another example of an electric shaver having a rinse channel system for washing the interior of the shaver head is known from document JP-2012-055384 A. So as to increase the washing effect of the rinsing water, steering elements are provided in the shaver head to spread the water into the corners of the hair dust chamber.

SUMMARY OF THE INVENTION

It is an objective underlying the present invention to provide for an improved shaver avoiding at least one of the disadvantages of the prior art and/or further developing the existing solutions. A more particular objective underlying the invention is to provide for easier, self-explaining handling of the shaver head during washing and to avoid undesired splashing and misdirection of rinsing water. A still further object underlying the present invention is to allow for a more efficient cleaning of a shaver head by means of rinsing water through the interior thereof, but still retaining hair dust in the interior of the shaver head during shaving.

To achieve at least one of the aforementioned objectives, the electric shaver, according to an aspect, has an improved rinse opening structure allowing water or other fluids to enter into the interior of the shaver head more easily and to rinse therethrough more efficiently. More particularly, the rinse opening is adapted to increase speed and volume of rinsing water entering into the interior of the shaver head. In accordance with one aspect, said rinse opening forms a funnel-like inlet channel having a horn-shaped contour with a cross-section continuously and smoothly expanding towards the ambience of the shaver and/or away from the shaver housing towards the outside. The deeper the cross-section is taken, the smaller it is. Due to such funnel-shaped, smooth contour of the rinse opening, the shaver can be easily positioned under a faucet with the rinse opening being aligned with the water jet coming therefrom and, at the same time, the water entering into the rinse opening is accelerated to enter into the interior of the shaver head with an increased velocity, thereby improving cleaning efficiency. Said rinse opening may open to the ambient atmosphere and/or connect the shaver head's interior to the ambiance.

On the other hand, such horn- or trumpet-shaped contour of the rinse opening is not only advantageous with regard to cleaning of the shaver head, but may also improve the acoustics of the shaver during operation thereof. The sound generated by the cutter elements and the hair cutting process is transmitted from the interior of the shaver head to the ambience via said horn-shaped openings, thereby providing for an amplification of the shaving sound and creating the impression of a very powerful, strong cutting capacity.

So as to further increase the cleaning efficiency, the rinse opening or a rinse channel connected therewith may be provided with at least one ramp-shaped guiding surface such as a projection for guiding and directing the incoming water towards the cutter elements and/or drive train elements in the interior of the shaver head and/or to other relevant portions thereof needing strong cleaning action. In particular, such guide projection may have a wedge-shaped contour forming a ramp for directing the rinse water into the central interior portion of the shaver head and changing the rinsing direction.

According to another aspect, the shaver may include a pair of rinse openings positioned on opposite sides of the shaver and connected to each other via a connection channel allowing at least a portion of water incoming from one of the pair of rinse openings to be drained via the other one of the rinse openings. Another portion of the incoming water may be rinsed through the interior of the shaver head to achieve cleaning thereof. More particularly, each of said pair of rinse openings may be configured and/or connectable to the shaver head's interior so as to rinse water or other rinsing fluid into the shaver head's interior. On the one hand, such arrangement of a pair of rinse openings connected to each other allows for easy use of the rinse openings and makes handling of the shaver less complicated as the user may position the shaver with different sides under the faucet of a sink to have water rinsed through the shaver head. On the other hand, the connection between the rinse openings allows excessive amounts of water to be drained through the opposite rinse opening and thus, avoids undesired splashing.

The connection channel together with the pair of rinse openings may form an hourglass-shaped contour providing for a bottleneck contraction and/or narrowing of the path for the water flowing through the rinse channel system, where velocity of the rinsing water is increased so that rinsing water at increased speed and/or increased pressure may be directed into the interior of the shaver head via rinse channels branching off from said channel portion of restricted cross-sectional area. Such hourglass-shaped contour may be given in at least one longitudinal cross-section taken in a plane including or tangential to the rinse openings' longitudinal axes. Such hourglass-like contour may be given in more than one of such longitudinal cross-sections and/or said pair of rinse openings together with the connection channel may have such hourglass-like contour when considering their three-dimensional shape in their entirety.

According to a further aspect, the pair of rinse openings together with the connection channel therebetween may give a line of sight through said shaver from one side to the opposite side thereof so that a user may look through the shaver head from one side thereof to the opposite side thereof. This allows a user to inspect the result of the cleaning process and/or the degree of dust deposits to decide whether another cleaning process is necessary. At the same time, such sight corridor allows ambient light to enter into the interior of the shaver head from opposite sides thereof to illuminate interior surfaces. Such ambient light from the opposite side helps in inspecting the cleaning result when looking into the rinse opening on the other side of the shaver head.

According to a further aspect, an automatic valve may be provided to open and close the connection of the rinse opening to the interior of the shaver head, such valve being adapted to automatically open when rinsing water enters into the rinse opening at a predetermined pressure and/or at a predetermined velocity and/or at a predetermined volume. In addition or in the alternative, said automatic valve may be adapted to automatically close when there is no rinsing water coming in through the rinse opening.

Such automatic valve may include an elastic valve flap and/or a biased valve element movably supported and biased into its closing position.

These and other advantages become more apparent from the following description giving reference to the drawings and possible examples.

DETAILED DESCRIPTION OF THE INVENTION

Figure 1:
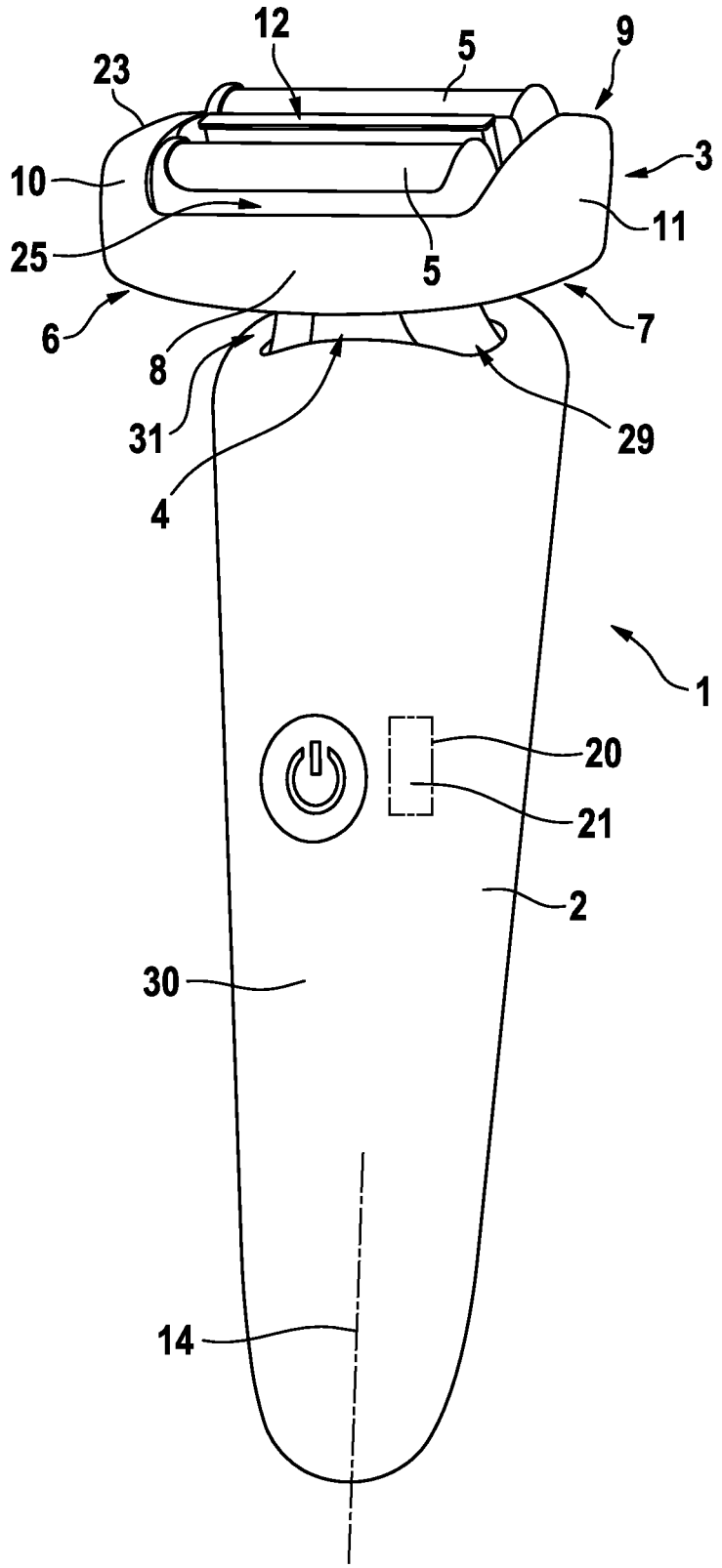
FIG. 1: is a perspective, schematic view of an electric shaver having a shaver head supported by a handle portion, said shaver head including cutter elements drivable in an oscillating manner along a longitudinal axis thereof at a front face of the shaver head.

To provide for easier, self-explaining handling of the shaver head during washing and to avoid undesired splashing and misdirection of rinsing water, the electric shaver, according to an aspect, has an improved rinse opening structure allowing water or other fluids to enter into the interior of the shaver head more easily and to rinse therethrough more efficiently. More particularly, the rinse opening is adapted to increase speed and volume of rinsing water entering into the interior of the shaver head, wherein said rinse opening may form a funnel-like inlet channel with a horn-shaped contour with a cross-section continuously expanding away from the shaver housing towards the outside and/or towards the ambience of the shaver. The deeper in the shaver head the cross-section is taken, the smaller it is. For example, an outermost cross-section of the rinse opening may have an area twice as large or three times as large as the area taken in an inner central section of the shaver head.

Due to such funnel-shaped, smooth contour of the rinse opening, the shaver can be easily positioned under a faucet with the rinse opening being aligned with the water jet coming therefrom and, at the same time, the water entering into the rinse opening is accelerated to enter into the interior of the shaver head with an increased velocity, thereby improving cleaning efficiency. At the same time, such horn-shaped or trumpet-like contour of the rinse opening also improves the acoustics of the shaver during operation thereof. The sound generated by the cutter elements and the hair cutting process is transported from the interior of the shaver head to the ambience via said horn-shaped openings, thereby providing for an amplification of the shaving sound and creating the impression of a very powerful, strong cutting capacity. Thus, the suggested contour of the rinse opening achieves a double function in terms of improving the handling of the shaver head during washing and avoiding undesired splashing and misdirection of rinsing water on the one hand, and improving the acoustics of the shaver during operation on the other hand.

The horn-shaped contour of the rinse opening may be formed to have a smooth surface without steps to continuously expand towards the ambience of the shaver. Advantageously, the rinse opening may have a rounded cross-section without corners such as a circular or elliptical or oval cross-section, wherein the shape of the cross-section may be the same, for example circular, from the outermost end of the rinse opening to the innermost section thereof. However, it also would be possible to vary the cross-sectional shape over the extension of the opening, wherein for example an outermost section may have a circular cross-section which may transform into an elliptical cross-section towards an inner section of the opening.

The funnel-shaped contour of the rinse opening may form a jet nozzle for significantly increasing the rinsing speed of the washing fluid. For example, the horn- and/or funnel-shaped contour of the rinse opening may narrow, in a direction from the ambience towards an inner side of the shaver head, from a larger cross-section continuously to a smaller cross-section, wherein the area of said smaller cross-section may be less than 75% or less than 66% or less than 50% of the area of said larger cross-section. Said cross-sections may be taken substantially perpendicular to the flow direction of the washing fluid entering the shaver head. In addition or in the alternative, so as to avoid undue flow restrictions with vortices, the funnel- or horn-shaped contour may have a length, in the direction from the ambience to the inner side of the shaver head, which length is considerably larger than the wall thickness of the material forming the shaver head's wall. For example, said length of the horn-shaped contour may exceed at least 50% or 75% or 100% of the diameter of said larger cross-section of the horn-shaped contour, wherein such diameter may be considered to be maximum width or the longest cross-sectional extension of the opening when said opening is not circular, but rectangular or elliptical or triangular or in any other non-circular shape.

So as to further increase the cleaning efficiency, the rinse opening may be provided with at least one ramp-shaped guiding surface such as a projection for guiding and directing the incoming water towards the cutter elements and/or drive train elements in the interior of the shaver head and/or to other relevant portions thereof needing strong cleaning action. In particular, such guide projection may have a wedge-shaped contour for ramping the rinse water into the central interior portion of the shaver head and changing the rinsing direction. Aside from such guide projection, the rinse opening may have the aforementioned smooth and stepless contour with rounded cross-sectional shapes.

The aforementioned ramp-shaped guiding projection may be associated with a rinse channel connecting the rinse opening with a hair dust collection chamber within the shaver head. Such rinse channel may branch off from said rinse opening at an acute angle thereto. For example, the rinse opening may have a longitudinal axis extending substantially perpendicular to the longitudinal axis of the handle portion, whereas said rinse channel connected to the rinse opening may extend at an acute angle to said longitudinal axis of the handle portion so as to direct the incoming water further upwards to the cutter elements.

The aforementioned ramp-shaped projection may be configured such that the incoming water in the rinse opening is redirected and/or guided into the aforementioned rinse channel More particularly, such guiding projection may be formed as a nose at a downstream side of the mouth of the rinse channel into the rinse opening so that such nose-shaped guiding projection catches the incoming water to direct it into the rinse channel. The downstream side of the mouth of the rinse channel into the rinse opening may further project into the rinse opening as the upstream side of said mouth, wherein the aforementioned terms downstream and upstream consider the direction of flow of the rinse water incoming through the rinse opening wherein such water flow direction may be substantially parallel to the longitudinal axis of the rinse opening.

In the alternative or in addition, such ramp-shaped guide projection can be provided on a wall section of the rinse opening opposite to the aforementioned mouth of the rinse channel into the rinse opening. For example, if the rinse channel branches off from an upper side of the rinse opening, the guide projection can be provided on a lower side of the rinse channel to direct the incoming water upwards into the mouth of the rinse channel. Needless to say that such terms upper or lower sides depend on the orientation of the shaver, wherein the aforementioned example is to be considered when the shaver is held in an upright position with the shaver head above the handle portion.

Said ramp-shaped projection may have a guiding surface having a longitudinal axis along which the washing fluid flows on said guiding surface, wherein said guiding surface, with its longitudinal axis, is inclined at an acute angle to the longitudinal axis of the funnel-shaped or horn-shaped contour of the rinse opening. Said acute angle of inclination of said guiding surface of the ramp-shaped projection may range from, for example, 5° to 85° or from 10° to 75° or 20° to 60° or angular ranges in between those ranges. So as to achieve a smooth deflection of the fluid flow, an upstream portion of the ramp-shaped projection may be inclined at a smaller angle to said longitudinal axis of the rinse opening, whereas a downstream portion of the ramp-shaped projection may be inclined at a larger angle, and/or the inclination of the ramp-shaped projection may continuously increase in the direction of flow. For example, an upstream end portion may be inclined to the longitudinal axis of the rinse opening at an angle of less than 10°, and a downstream end portion of said ramp-shaped projection may be inclined at an angle of more than 30° or more than 45° or an angle ranging from 30° to 75°, wherein a middle portion of the ramp-shaped projection between the upstream and downstream end portions thereof may be inclined at angles of more than 10° and less than the inclination angle of the downstream end portion.

According to another aspect, the shaver may include a pair of rinse openings positioned on opposite sides of the shaver and connected to each other via a connection channel allowing water incoming from one of the pair of rinse openings to be drained via the other one of the rinse openings. On the one hand, such arrangement of a pair of rinse openings connected to each other allows for easy use of the rinse openings and makes handling of the shaver less complicated as the user may position the shaver with different sides under the faucet of a sink to have water rinsed through the shaver head. On the other hand, the connection between the rinse openings allows excessive amounts of water to be drained through the opposite rinse opening and thus, avoids undesired splashing.

The connection channel together with the pair of rinse openings may form an hourglass-shaped contour providing for a sort of bottleneck contraction of the path for the water flowing through the rinse channel system, where velocity of the rinsing water is increased so that rinsing water at increased speed and/or increased pressure may be directed into the interior of the shaver head via rinse channels branching off from said channel portion of restricted cross-sectional area. Such hourglass-like contour of the rinse openings and the connection channel might be given in at least one longitudinal cross-section therethrough which longitudinal cross-section may be taken in a plane containing the longitudinal axis of the connection channel and/or tangential thereto. Such hourglass-like contour may be given in other longitudinal cross-sections.

Said pair of rinse openings and/or said connection channel—or the at least one rinse opening if there is only one rinse opening—may have a ring-shaped cross-sectional contour and/or may form, at least in part, a closed ring channel in terms of, e.g., a pipe or a similar hose-like structure.

According to a further aspect, the pair of rinse openings together with the connection channel therebetween may form a sight corridor through said shaver from one side to the opposite side thereof so that a user may look through the shaver head from one side thereof to the opposite side thereof. This allows a user to inspect the result of the cleaning process and/or the degree of dust deposits to decide whether another cleaning process is necessary. At the same time, such sight corridor allows ambient light to enter into the interior of the shaver head from opposite sides thereof to illuminate interior surfaces. Such ambient light from the opposite side helps in inspecting the cleaning result when looking into the rinse opening on the other side of the shaver head.

According to a further aspect, an automatic valve may be provided to open and close the connection of the rinse opening to the interior of the shaver head, such valve being adapted to automatically open when rinsing water enters into the rinse opening at a predetermined pressure and/or at a predetermined velocity and/or at a predetermined volume. In addition or in the alternative, said automatic valve may be adapted to automatically close when there is no rinsing water coming in through the rinse opening.

Such automatic valve may include an elastic valve flap and/or a biased valve element movably supported and biased into its closing position. More particularly, the valve may be configured to automatically go into its closing position if there are no water or other forces acting on it. The valve may elastically regain its starting position which may be the closing position.

Such valve may be positioned at different sections of the rinse opening and/or the aforementioned rinse channel continuing the path for the rinse water incoming through the rinse opening. For example, the valve may not be positioned at the outermost section of the rinse opening, but may be positioned deeper inside the rinse opening and/or rinse channel structure a certain distance away from the outermost section of the rinse opening. Thus, said outermost section of the rinse opening stays open and signals to the user its function that rinse water may be introduced via said opening.

More particularly, said valve may be positioned in a region where the rinse opening connects to the rinse channel branched off from the rinse opening and extending towards the cutter elements. For example, the valve may control the opening of the mouth of the rinse channel into the rinse opening.

Advantageously, the valve may be positioned such deep in the rinse opening and channel structure that, irrespective of the valve being closed or opened, the connection of the two opposite rinse openings with each other is left open. In other words, the valve may close the connection of the rinse openings to the hair dust collection chamber deeper inside the shaver head, but may leave open the connection of a first rinse opening to the second rinse opening so that water incoming through the first rinse opening still may leave via the second rinse opening. Even when the valve is closed, the aforementioned sight corridor formed by the opposite rinse openings together with the connection channel may remain unblocked to allow for a visual inspection.

According to a further aspect, there may be at least two automatic valves for controlling the flow between the rinse opening and the interior of the shaver head, wherein such at least two valves may be associated with said aforementioned pair of rinse openings. More particularly, a first valve may control flow of fluid coming in via a first one of said rinse openings, whereas a second one of the valves may control flow of fluid coming in from a second one of said rinse openings. In addition or in the alternative, one of said valves may control incoming flow, i.e. fluid flowing from the rinse opening into the interior of the shaver head, whereas a second one of the valves may control outflow, i.e. fluid to be drained from the interior of the shaver head.

Such plurality of valves may be controlled independently from each other. However, according to an advantageous aspect, the valves may be configured to open and close in a way adapted to each other. For example, when water is introduced through one of the rinse openings, one of the valves may open whereas another one of the valves may close so as to direct the water to all relevant portions of the interior of the shaver head in a sort of circular washing flow where water is drained only via the perforations of the shear foil and other gaps and openings.

In the alternative, the valves can be configured and/or controlled to open at the same time when water is incoming through one of the rinse openings, thus achieving a washing flow where water is introduced into the interior of the shaver head via one of the valves and water is drained from the interior of the shaver head not only via the perforations of the shear foil, but also through the second valve. Such through flow may achieve additional cleaning of portions of the interior of the shaver head closer to the second valve as the second open valve may result in increased flow velocities in regions neighboring such second valve.

The plurality of valves can be controlled in different modes, wherein for example in a first mode of operation, one valve is opened and the other one is closed when water is introduced through one of the rinse openings and wherein in a second mode both valves are opened when water is introduced via one of the rinse openings.

The aforementioned and other features become more apparent from the examples shown in the drawings. As can be seen from FIG. 1, shaver 1 may have a shaver housing 30 forming a handpiece or handle portion 2 for holding the shaver 1, wherein said handle portion 2 may have different shapes such as—roughly speaking—a substantially cylindrical shape or a box shape or a bone shape allowing for ergonomically grabbing and holding the shaver 1, wherein such handle portion 2 has a longitudinal axis 14 due to the elongated shape of such handle portion 2, cf. FIG. 1.

On one end of said handle portion 2, a shaver head 3 is attached to said handle portion 2, wherein the shaver head 3 can be supported movably relative to the shaver housing 30. In particular, the shaver head 3 may be pivotably supported about a pivot axis extending substantially perpendicular to the longitudinal axis 14 of the handle portion 2, wherein it is also possible that a multi-axial pivotable support is provided for the shaver head 3 allowing for pivoting movements about more than one axis. For example, the shaver head 3 may be pivotably supported about a swivel axis and about a tilting axis, said swivel and tilting axes extending perpendicular to each other and substantially transverse to the longitudinal axis 14 of the handle piece 2. "Substantially transverse" does not necessarily mean exactly perpendicular in a mathematical sense, but may be considered to mean at least roughly perpendicular such 90°±25° or 90°±15°. Other movable support configurations including three or more movement axes may be provided for the shaver head 3.

Figure 2:
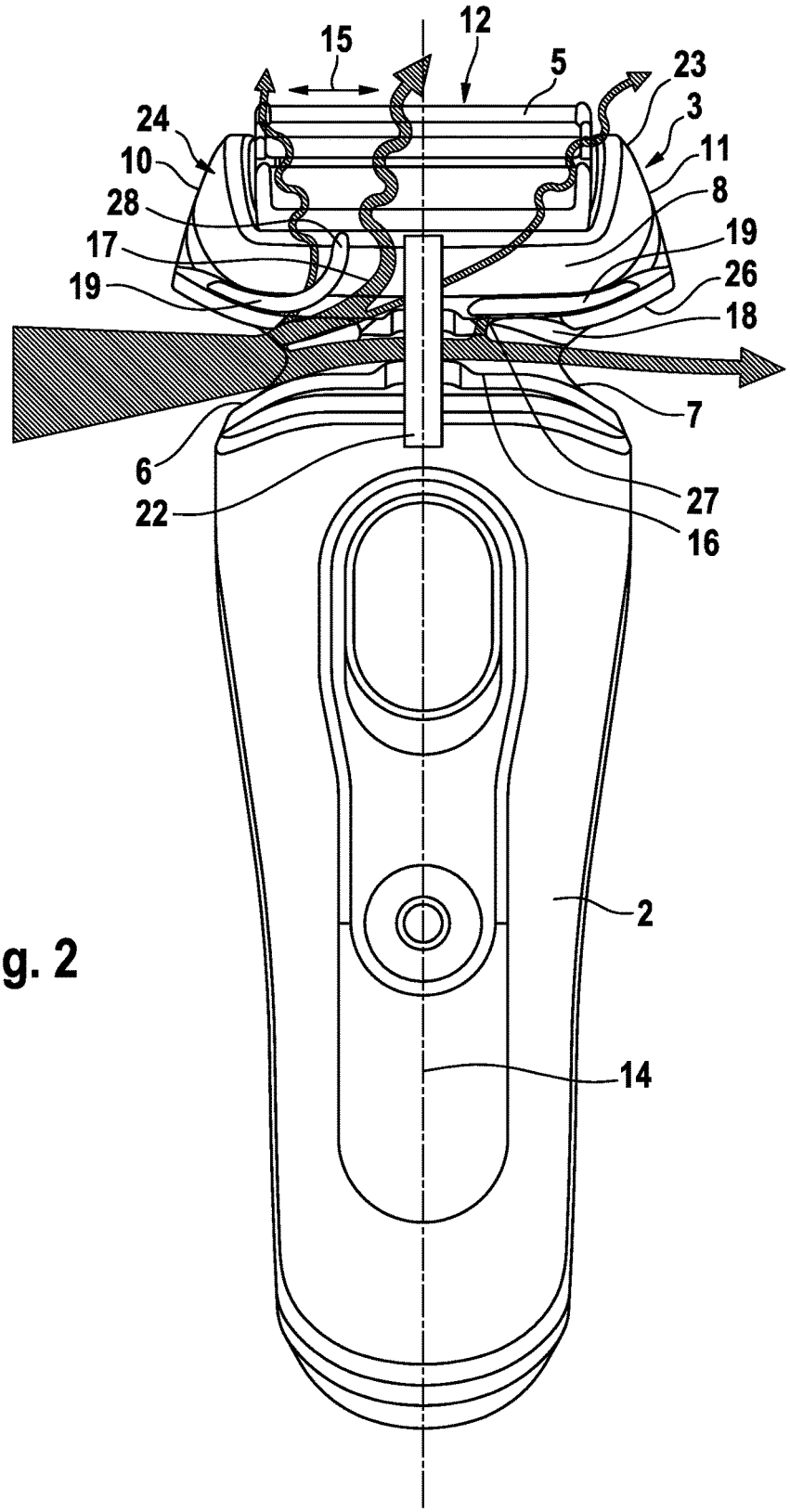
FIG. 2: a schematic plane view of the shaver of FIG. 1, wherein the shaver head and the shaver neck between the shaver head and the handle portion is shown in a partial cross-sectional view illustrating a pair of rinse openings and the rinse channel system connecting the rinse openings with the interior of the shaver head, wherein an automatic valve flap controlling said connection between the rinse openings and the interior of the shaver head is shown opened by the incoming water.
Figure 3:
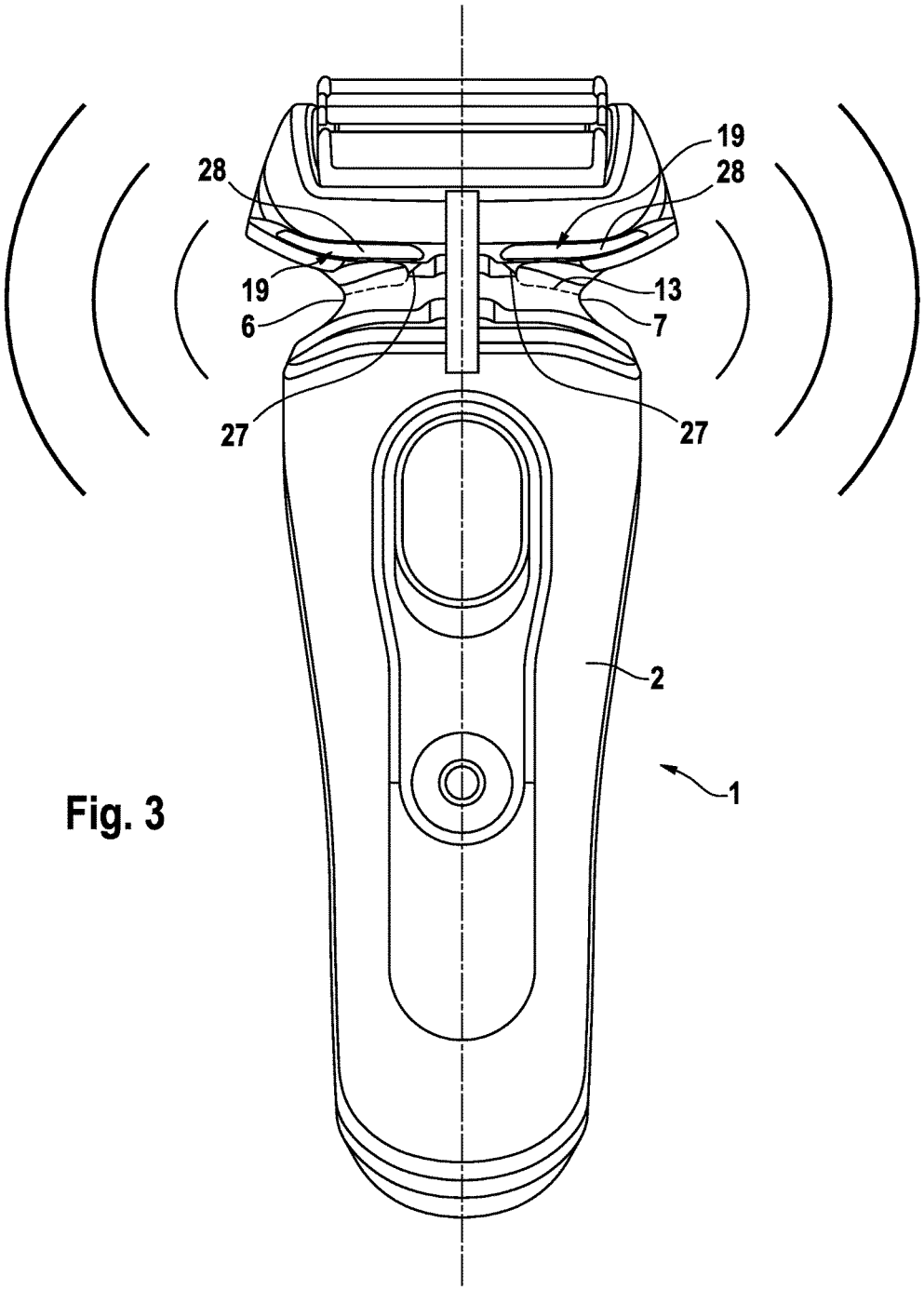
FIG. 3: is a schematic plane view of the shaver similar to FIG. 2, wherein the acoustic effect of the trumpet-shaped rinse opening during shaving an operation of the shaver is illustrated.

As can be seen from FIGS. 1 and 2, the shaver head 3 may include a pair of cutter elements 5, wherein in the alternative only one or three or more than three of such cutter elements 5 may be provided. Such cutter elements 5 may form block-like undercutters with a plurality of shearing blades cooperating with a shear foil covering the respective cutter elements 5 which may have an elongated shape with a longitudinal cutter element axis extending substantially perpendicular to the longitudinal axis 14 of the handle portion 2 and/or parallel to a cutter oscillation axis 15 of the cutter element 5 along which the cutter elements may be driven in a reciprocating manner.

A drive unit 20 for driving the cutter elements 5 may include an electric motor 21 which may be accommodated within the shaver housing forming the handle portion 2. Such motor 21 may be connected to the cutter elements 5 by means of a drive train which may have various configurations and may include a transmitter 22 extending through a neck portion 4 into the shaver head 3, said neck portion 4 being provided between the shaver head 3 and the handle portion 2.

In addition to the reciprocating, linear cutting movements, said cutter elements 5 may dive relative to the shaver head 3 and the body thereof to achieve a better adaption to the skin contour, wherein such cutting and diving movements of the cutter elements 5 relative to the shaver head body may be in addition to the aforementioned pivoting and/or swiveling and/or tilting movements of the entire shaver head 3 relative to the handle portion 2.

A body 24 of shaver head 3 may be formed by a shaver head housing 23 surrounding an interior of shaver head 3 through which the transmitter 22 for driving the cutter elements 5 may extend. Said cutter elements 5 may form a part of said body 24, wherein the cutter elements 5 may be received in recesses in the shaver head housing 23 and/or may form a part of the outer surface of body 24, cf. FIG. 2.

More particularly, the cutter elements 5 may be positioned at a functional face 12 of the shaver head 3 which may have a substantially block-shaped—roughly speaking—rectangular or elongated contour with a pair of oblong side faces 8 and 9 neighboring said functional face 12 and forming opposite sides of the body 24 of shaver head 3. A pair of small side faces 10 and 11 neighbor the functional face 12 and said pair of oblong side faces 8 and 9. Said small side faces 10 and 11 may be smaller than said oblong side faces 8 and 9 in terms of the surface area thereof. The aforementioned elongated cutter elements 5 may be arranged to have their longitudinal axes extend substantially parallel to the oblong side faces 8 and 9 of shaver head 3, cf. FIG. 1. As can be seen from FIG. 1, such substantially block-like body 24 does not need to have flat side faces and/or corners and/or an indeed rectangular shape in terms of a mathematical cuboid or parallelepiped, but it may have rounded junctions between its side faces and/or rounded edges and/or curved sides faces such as convex or concave surfaces. In general, the aforementioned oblong side faces 8 and 9 have a larger surface area than the aforementioned small side faces 10 and 11 so that the oblong sides faces 8 and 9 on opposite sides of the shaver head 3 may define a main axis of the shaver head 3 extending parallel to or tangential to said oblong side faces and to the functional face 12.

As can be seen from FIG. 1, the shaver head 3 may be positioned spaced apart from the handle 2 with a gap 31 defined between the bottom face of the shaver head 3 and the top face of the handle 2. Such gap 31 may have a width in the range of, e.g., a couple of millimeters, for example 5 mm or more, or 10 mm or more. Such gap 31 may be bridged by the support structure 29 connecting the shaver head 3 to the handle 2 and/or by a transmitter 22 for driving the cutter elements 5 from a motor positioned in the handle 2. Such support structure 29 and the transmitter 22 together form the neck of the shaver 1 connecting the shaver head 3 to the handle 2, wherein such neck has a cross-sectional area which is considerably smaller than the cross-sectional area of the handle 2 and/or the cross-sectional area of the shaver head 3 when considering a cross-sectional plane transverse to the longitudinal axis 14 of handle 2. For example, the cross-sectional surface area of the neck may be less than 50% or less than 30% of the cross-sectional surface area of the shaver head 3 and/or the cross-sectional surface area of the handle 2. Thus, the shaver may have a substantially ring-shaped contraction in its outer contour around the neck 4 between the handle 2 and the shaver head 3, thereby giving space and access to the bottom side of shaver head 3.

Due to such spaced apart arrangement of the shaver head 3 and the aforementioned gap between the shaver head 3 and the handle 2, cleaning efficiency may be increased and rinsing through it may be better and more efficiently introduced into the shaver head 3 and/or directed onto the support structure 29 and/or the transmitter 22.

Figure 4:
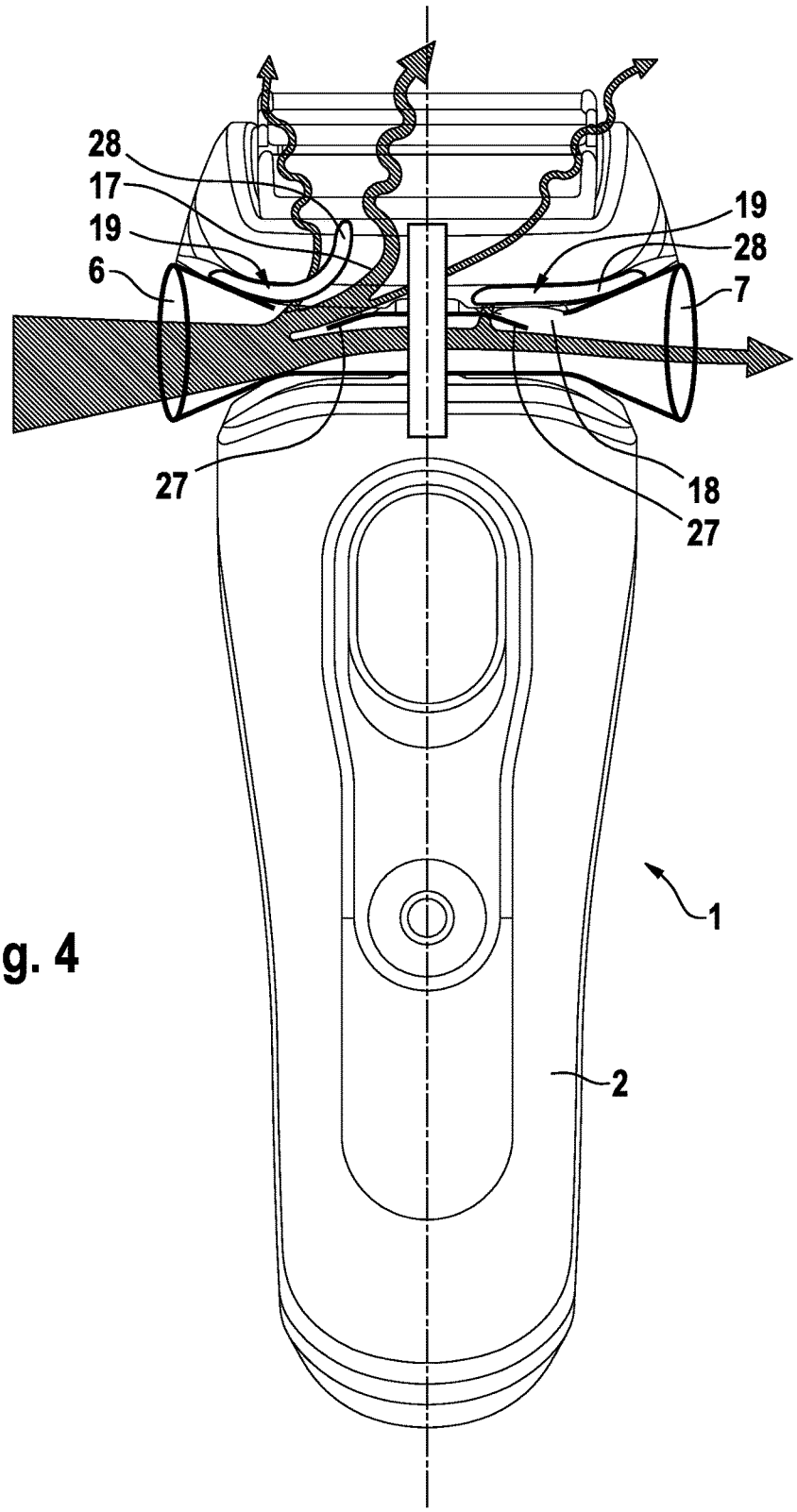
FIG. 4: a plane view of a shaver similar to FIG. 2 with the shaver head and the neck between the shaver head and the handle portion being shown in a partial cross-sectional view to illustrate a ramp-shaped water guiding projection at the bottom of the trumpet-shaped inlet opening for guiding rinse water into the interior of the shaver head.

As can be seen from FIGS. 2 and 4, the shaver head housing 23 is provided with a pair of rinse openings 6 and 7 for introducing rinsing water into the interior of the shaver head 3. Rinsing water entering into the interior of shaver head 3 via one of said rinse openings 6 or 7 may wash elements accommodated in the interior of the shaver head 3 such as parts of elements of the aforementioned drive train or transmitter 22, or in particular the cutter elements 5 and/or other interior surfaces of the shaver head 3 onto which hair dust and chipped hair stubbles may have been deposited. Such rinsing water may be drained from the interior of the shaver head 3 via the perforations of the shear foil covering the surface of the cutter elements 5 and/or via other gaps and recesses formed in the shaver head 3, in particular between the cutter elements 5 and the shaver housing 23.

In particular, the rinsing water may enter into the dust chamber or chipped hair chamber formed beneath the cutter elements 5 to collect the hair debris and/or preventing the hair dust from spreading out of the interior of the shaver head 3. Such hair dust collection chamber 25 may be surrounded by the shaver head housing 23 and/or interior walls connecting to outer walls of the body structure of the shaver head 3 so that a substantially—roughly speaking—encapsulated space surrounding and/or beneath the cutter elements 5 is defined by such hair dust collection chamber. The rinse openings 6 and 7 may be connected to such hair dust collection chamber 25 in the interior of the shaver head 3 by means of rinsing channels as will be explained further.

As can be seen from FIGS. 2 and 4, the aforementioned rinse openings 6 and 7 may open to opposite sides of the shaver neck. Advantageously, the rinse openings 6 and 7 may open toward the small side faces 10 and 11 and/or towards the neck portion 4 and/or towards a bottom face 26 of shaver head 3. The rinse openings 6 and 7 each have a longitudinal axis 13 which may extend substantially transverse to the longitudinal axis 14 of handle portion 2 and/or substantially parallel to the oblong side faces 8 and 9 of shaver head 3 and/or substantially parallel to the longitudinal axis of the elongated cutter elements 5 and/or substantially parallel to the drive axis 15 of said cutter elements 5. Said longitudinal axis 13 of the rinse opening 6 and 7 means the extension of the inlet portion of said openings 6 and 7 which extend from said small side faces 10 and 11 towards the center of the shaver head 3. Said longitudinal axis 13 of the rinse opening may be a straight line or a slightly curved line going through the center of the rinse opening.

As can be seen from FIGS. 2 and 4, each of said rinse openings 6 and 7 has a funnel-like, horn-shaped contour continuously expanding towards the ambience of the shaver 1. The horn- or funnel-shaped rinse openings forms an inlet channel which is significantly longer than, for example, a beveled edge of a recess or the chamfered end of a borehole. The horn- or funnel-shaped contour of each rinse opening may extend over 10% or 20% or 30% of the shaver head's width measured in the direction of the cutter oscillation axis 15, wherein, however, it does not have to be formed over the entire length of the channel guiding the rinsing fluid into the interior of the shaver head. For example, such horn-shaped contour may have a length of 10 mm or 20 mm or 30 mm or within a range between those figure.

More particularly, the rinse openings 6 and 7 smoothly and continuously get slimmer and slimmer the deeper the cross-section is taken, wherein such cross-section may be taken in planes parallel to the longitudinal axis 14 of the handle portion 2 and perpendicular to the longitudinal axis 13 of the rinse openings 6 or 7 and/or parallel to the drive axis 15 of the cutter elements 5.

Such funnel-like widening of the rinse openings may be given in only one or some longitudinal cross-sections. For example, when the rinse opening 6 or 7 has an oval cross section, it may be only the longer axis of the oval cross-section that becomes longer when taking the cross-section closer to the outer end of the rinse opening 6 or 7, whereas the shorter axis of the oval cross-section may have the same length in different cross-sections. The rinse opening 6 or 7 may have a circular cross-section that may expand in all longitudinal cross-sections what also may be given for other cross-sectional shapes such as elliptical cross-sections. However, as mentioned the expanding of the rinse openings 6, 7 may be given in only one or some longitudinal cross-sections. For example, such expanding of the cross-section may be given in a cross-sectional plane substantially parallel to the handle's longitudinal axis 14 and the cutter oscillation axis 15 and/or planes slightly inclined thereto, whereas in cross-sectional planes transverse to the handle's longitudinal axis 14 no such expanding may be given.

Said pair of rinse openings 6 and 7 opening to opposite sides of the shaver 1 are connected with each other by means of a connection channel 16 so that water or other fluid incoming via one of the rinse openings 6 and 7 may be drained via the other one of said rinse openings 6 and 7. Said connection channel 16 forms a bottleneck-like restriction where the introduced fluid flows at an increased velocity, wherein the horn-shaped rinse openings 6 and 7 together with said connection channel 16 may form an hourglass-like contour.

As it is apparent from FIG. 2, said pair of rinse openings 6 and 7 together with the connection channel 16 form a sight corridor through which a user may look from one side of the shaver 1 to the other side thereof. Basically, such sight corridor may be achieved by means of forming the horn-shaped inlet openings 6 and the connection channel 16 with substantially straight and aligned longitudinal axes. On the other hand, the longitudinal axis of the rinse openings 6 and 7 and/or the longitudinal axis of the connection channel 16 may be slightly curved. Nevertheless, as long as the cross-section is large enough, said sight corridor may be formed allowing to look from one side to the other side of the shaver through the body of the shaver head 3.

So as to let the water rinse into the interior of the shaver head 3, rinse channels 17 and 18 may fork off to connect the hourglass-like through-hole structure formed by the rinse openings 6 and 7 and the connection channel 16 with the interior of the shaver head 3, in particular with the hair dust collection chamber 25 formed therein. Such rinse channels 17 and 18 may extend at an acute angle relative to the longitudinal axis 13 of the rinse openings 6 and 7, wherein more particularly the rinse channels 17 and 18 may be directed towards the cutter elements 5, cf. FIG. 2 and FIG. 4. When considering the shaver 1 in an upright position with the shaver head 3 above the handle portion 2, as it is shown in FIGS. 1-4, the rinse channels 17 and 18 may fork off the upper side of the rinse openings 6 and 7 and/or the rinse connection channel 16. In particular, the rinse channels 17 and 18 each may have a mouth going into the rinse openings 6 and 7 and/or the connection channel 16, which mouth may be positioned at an upper section of the wall forming the rinse openings 6 and 7 and/or the connection channel 16.

So as help the water flow into the interior of the shaver head 3 via said rinse channel 17 and 18, flow guiding means may be provided to guide water coming in via the rinse openings 6 or 7 into the mouth of the rinse channels 17 and 18. More particularly, such flow guiding means may include a ramp-shaped projection 27 associated with said mouth and/or arranged in the vicinity of such mouth. As shown by FIGS. 2 and 4, such projection 27 may include a nose on the downstream side of the mouth of the rinse channel 17 and 18 into the rinse openings 6 and 7, which nose projects deeper into the rinse openings 6 and 7 and/or the connection channel 16 than the upstream side of the mouth of the rinse channels 17 and 18 does. Such nose forming the projection 27 catches the incoming water and helps it to be redirected into the rinse channels 17 and 18. When considering the upright position of the shaver 1 as shown in FIGS. 2 and 4, said projection 27 may include a shovel-like contour looking toward the incoming flow of water, wherein such projection 27 may extend from the upper wall of the rinse openings 6 or 7 on the downstream side of the rinse channels 17 and 18 so as to direct the incoming water upwards into the shaver head 3 towards the cutter element 5.

So as to control flow from the rinse openings 6 and 7 into the interior of shaver head 3 and/or to control migration of hair dust from the interior of the shaver head 3 into the rinse openings 6 and 7, automatic valves 19 may be associated with the rinse channels 17 and 18, as it is apparent from FIGS. 2 and 4. In particular, such valves 19 may be positioned in a region where the rinse channels 17 and 18 branch off from the rinse openings 6 and 7 and/or from the connection channel 16. In particular, such valves 19 may open and close the mouth of the rinse channels 17 and 18 into the rinse openings 6 or 7 and/or into the connection channel 16.

As can be seen from FIGS. 2 and 4, such valves 19 each may include an elastic flap 28 which may be formed by a thin, plate-like elastic material such as a plastic material and/or an elastomer material. For example, such valve flap 28 may be formed as a thin elastic membrane which is arranged to cover the opening that communicates the interior of the rinse openings 6 and 7 and/or the connection channel 16 with the hair dust collection chamber 25. More particularly, the elastic flap 28 may be supported and/or fixed to a structural part of shaver head 3 so as to extend over the aforementioned mouth of the rinse channel 17 and 18.

So as to allow the incoming water to push the valve flap 28 into its opened position, said flap 28 may be configured and arranged such that it may flex away from the rinse openings 6 and 7 and/or the connection channel 16. For example, it may be positioned on the upper side of a wall in which the communication opening communicating the rinse openings 6 and 7 with the hair dust collection chamber 25 is formed. Thus, the flap 28 may flex away upwards when water incoming through one of the rinse openings 6 and 7 pushes against the flap 28, wherein "upwards" is again to be considered when the shaver 1 is in an upright position.

In the alternative to such elastic flaps, the valves 19 also could be configured as a sort of check valves opening under pressure from the rinse openings 6 and 7 and closing without such pressure and/or preventing flowback from the interior of the shaver head 3 into the rinse openings 6 and 7.

As can be seen from FIGS. 2 and 4, the valves 19 can be configured and/or controlled such that the valve 19 associated with the rinse opening 6 through which water is introduced, opens, whereas the other valve 19 associated with the opposite rinse opening 7 is closed, thus causing the water introduced into the interior of shaver head 3 to intensively wash the interior elements and surfaces of the shaver head including the cutter element 5. Such rinsing water may be drained via the perforations in the shear foil covering the undercutter.

In an alternative arrangement, the valves 19 could be configured and/or controlled such that the valve associated with the rinse opening 6 through which water is introduced opens under pressure in said rinse opening 6, whereas the other valve 19 associated with the other rinse opening 7 opens under pressure in the interior of shaver head 3. Thus, when water is introduced via rinse opening 6, in a first phase only valve 19 associated with such rinse opening 6 opens and water is introduced into the hair dust collection chamber where it washes all the elements therein. If pressure in the hair dust collection chamber 25 increases due to further water flowing into this chamber, the other valve 19 may open to allow for through-flow of water through the hair dust collection chamber 25, wherein water flows into said chamber via the first opened valve and leaves the chamber via the second opened valve.

In order to achieve the desired opening and/or closing characteristics of the valves, such valves 19 may be linked to each other by a mechanical linkage. In addition or in the alternative, control may be associated with each of the valves to apply a desired control regime to the valves 19 so as to achieve a desired opening and closing procedure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An electric shaver comprising a handle portion, a shaver head supported by said handle portion and including at least one drivable cutter element, and at least one rinse opening for rinsing water or other fluids through the interior of said shaver head, wherein said rinse opening forms a funnel-like inlet channel having a horn- or funnel-shaped contour with a cross-section continuously expanding towards the ambience of the shaver, wherein said shaver head has a functional face to be contacted with the skin to be shaved, a pair of oblong side faces neighboring said functional face and a pair of small side faces neighboring said functional face and said oblong side faces, wherein said at least one rinse opening opens toward one of said small side faces.

2. The electric shaver according to claim 1, wherein said at least one rinse opening has a longitudinal axis extending transverse to a longitudinal axis of said handle portion and extending substantially parallel to a drive axis of the cutter element.

3. The electric shaver according to claim 1, wherein said at least one rinse opening opens towards a neck portion of the shaver between the handle portion and the shaver head and/or towards one of said small side faces of the shaver head neighboring said oblong side faces of said shaver head.

4. The electric shaver according to claim 1, wherein said at least one rinse opening has a smooth contour free of steps and free of undercuts.

5. The electric shaver according to the claim 1, wherein the rinse opening has a cross-sectional contour the shape of which is the same in different cross-sections and the size of which is different in different cross-sections.

6. The electric shaver according to the claim 1, wherein the size of the cross-section is the smaller the deeper inside the rinse opening the cross-section is taken.

7. The electric shaver according to claim 1, wherein said horn- or funnel-shaped contour includes a larger cross-section having a cross-sectional area of at least 125% of the cross-sectional area of a smaller cross-section of said horn- or funnel-shaped contour and wherein a length of said horn- or funnel-shaped contour measured in the direction of flow through said rinse opening, is more than 50% of a diameter of said larger cross-section of said horn- or funnel-shaped contour.

8. The electric shaver according to the claim 1, wherein said at least one rinse opening comprises a pair of rinse openings, wherein said pair of rinse openings is provided on opposite sides of the shaver, wherein said pair of rinse openings is connected to each other via a connection channel allowing the rinsing water or other fluids coming in from one of said pair of rinse openings to be drained via the other of said rinse opening, wherein each of said rinse openings is connectable to the shaver head's interior to rinse water into the shaver head's interior from each of said rinse openings, wherein said pair of rinse openings and said connection channel, at least in one longitudinal cross-section, together define an hourglass-shaped contour with a necked section formed at least in part by said connection channel, wherein at least one rinse channel is branched off from said necked section to extend towards the cutter element and/or into the interior of the shaver head.

9. The electric shaver according to claim 8, wherein said pair of rinse openings and said connection channel together form a sight corridor through said shaver from one side thereof to the opposite side thereof.

10. The electric shaver according to claim 1, wherein an automatic valve is provided for automatically opening and closing a connection of said at least one rinse opening with the interior of the shaver head in response to rinsing fluid and/or flow of rinsing fluid in said at least one rinse opening.

11. The electric shaver according to claim 10, wherein said automatic valve is adapted to automatically open said connection of the rinse opening with the interior of the shaver head when a predetermined velocity and/or predetermined volume of rinsing fluid in the rinse opening is reached and/or exceeded, and/or said automatic valve is adapted to automatically close said connection of the rinse opening with the interior of the shaver head when there is no rinsing fluid in the rinse opening.

12. The electric shaver according to claim 10, wherein said automatic valve includes an elastic flap that elastically opens under pressure in the rinse opening and closes automatically in the absence of such pressure.

13. The electric shaver in accordance with claim 10, wherein two or more of such automatic valves are provided for controlling two or more communication openings communicating the at least one rinse opening with the interior of the shaver head, wherein such automatic valves are configured and/or controlled such that in a first mode of operation at least one of the valves is opened and at least a second one of the valves is closed to achieve one-way washing in the interior of the shaver head, and/or in a second mode of operation at least two of the valves are opened at the same time to achieve through-flow with water or fluid entering into the interior of the shaver head via a first one of said two opened valves and leaving the interior of the shaver head via a second one of said two opened valves.

14. The electric shaver according to claim 10, wherein said at least one valve is positioned spaced away from an outermost portion of the rinse opening which outermost section of said rinse opening is always open.

15. The electric shaver according to claim 1, wherein at least one flow-guiding projection is provided for redirecting rinsing fluid flowing in said rinse opening along the longitudinal axis thereof into the interior of the shaver head towards the cutter element.

16. The electric shaver according to claim 15, wherein said flow-guiding projection has a ramp-shaped contour extending at an acute angle relative to the longitudinal axis of the rinse opening and includes a shovel-like nose extending from a downstream side of a communication opening into the rinse opening towards an outermost section thereof and projecting against a flow direction of rinsing fluid coming in through said rinse opening.

* * * * *